US005091997A

United States Patent [19]

Foehl

[11] Patent Number: 5,091,997

[45] Date of Patent: Mar. 3, 1992

[54] PROTECTIVE HELMET, WITH PIVOTING AND LOCKING VISOR MECHANISM, PARTICULARLY FOR MOTORCYCLISTS

[76] Inventor: Artur Foehl, Auf der Halde 28, D-7060 Schorndorf, Fed. Rep. of Germany

[21] Appl. No.: 237,738

[22] PCT Filed: Nov. 17, 1987

[86] PCT No.: PCT/DE87/00524

§ 371 Date: Apr. 6, 1990

§ 102(e) Date: Apr. 6, 1990

[87] PCT Pub. No.: WO88/03766

PCT Pub. Date: Jun. 2, 1988

[30] Foreign Application Priority Data

Nov. 17, 1986 [DE] Fed. Rep. of Germany ..... 3639261
Jun. 24, 1987 [DE] Fed. Rep. of Germany ..... 8708787

[51] Int. Cl.[5] ..... A42B 1/08
[52] U.S. Cl. ..... 2/424; 2/425
[58] Field of Search ..... 2/6, 424, 15, 10, 9, 2/410, 425

[56] References Cited

U.S. PATENT DOCUMENTS

| | | | |
|---|---|---|---|
| 3,066,305 | 12/1962 | Aileo | 2/6 |
| 3,781,914 | 1/1974 | Ramsay | 2/10 |
| 3,945,043 | 3/1976 | DeAngelis | 2/424 |
| 4,170,792 | 10/1979 | Higgs | 2/10 |
| 4,292,688 | 10/1981 | Ellis | 2/6 |
| 4,305,160 | 12/1981 | Sundahl | 2/424 |
| 4,718,127 | 1/1988 | Rittmann et al. | 2/424 |
| 4,748,696 | 7/1988 | Fohl | 2/424 |
| 4,907,300 | 3/1990 | Dampney et al. | 2/424 |

FOREIGN PATENT DOCUMENTS

| | | |
|---|---|---|
| 2937356 | 4/1980 | Fed. Rep. of Germany . |
| 8005884 | 7/1980 | Fed. Rep. of Germany . |
| 2913059 | 10/1980 | Fed. Rep. of Germany . |
| 3143130 | 6/1982 | Fed. Rep. of Germany . |
| 1167451 | 10/1969 | United Kingdom . |
| 2024000 | 1/1980 | United Kingdom . |
| 1560723 | 2/1980 | United Kingdom . |

*Primary Examiner*—Werner H. Schroeder
*Assistant Examiner*—Michael A. Neas
*Attorney, Agent, or Firm*—Eckert Seamans Cherin & Mellott

[57] ABSTRACT

A helmet shell defines a face opening, and a visor covering the face opening is pivotally mounted on sides of the helmet shell for movement between a closed position and an open position. Locking elements on at least one side of the helmet shell maintain the visor in at least the closed position. A locking element which defines at least one recess is pivotable with the visor around a pivot point. A spring element is provided with upper and lower spring leaves. The upper spring leaf defines a locking cam which is engageable with the recess when the visor is in the closed position. The spring element releasably biases the locking cam, against a side wall of the recess whereby the visor is releasably maintained in the closed position.

18 Claims, 4 Drawing Sheets

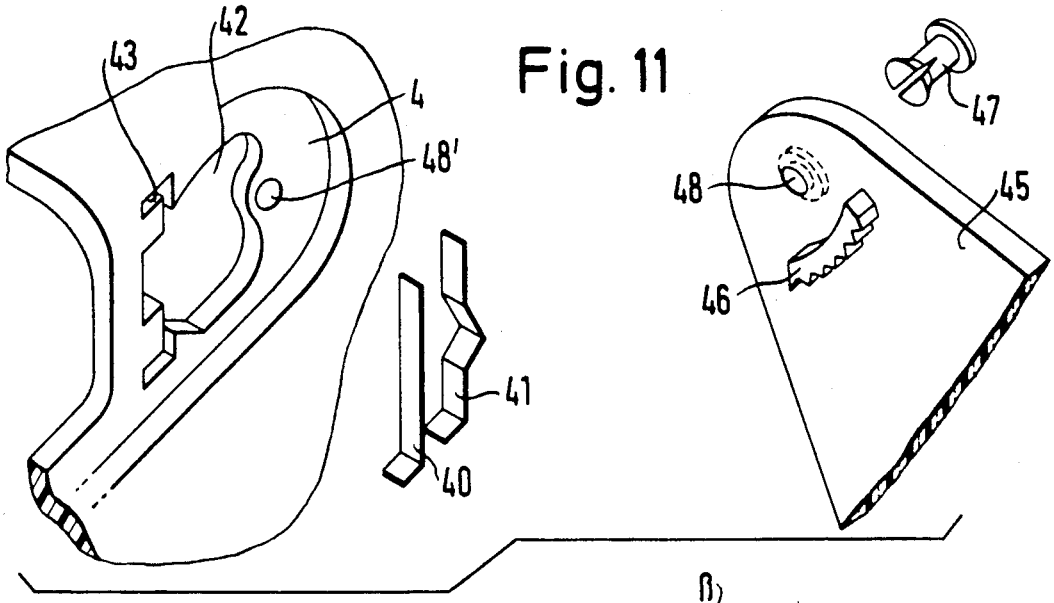
Fig. 11
Fig. 12
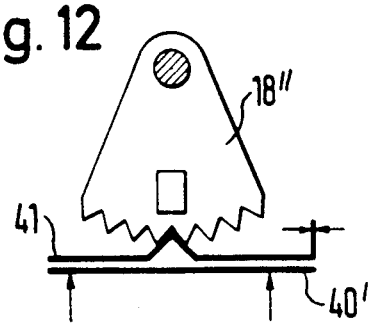
Fig. 13
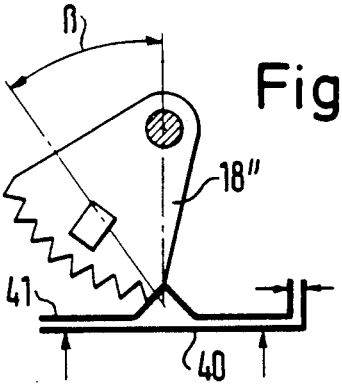
Fig. 14
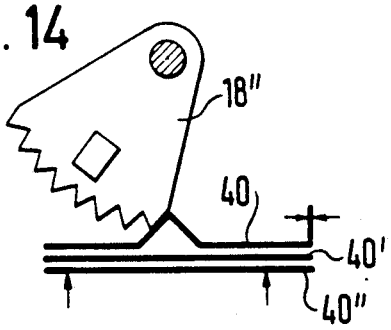
Fig. 15
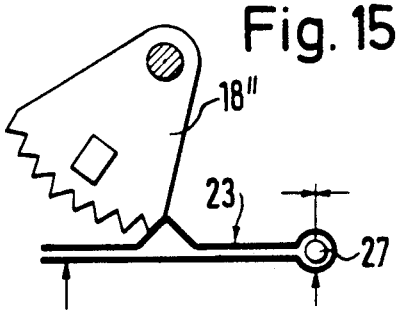
Fig. 16
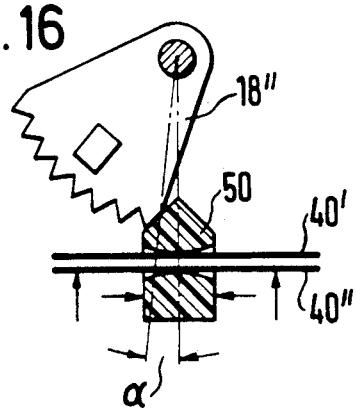
Fig. 17
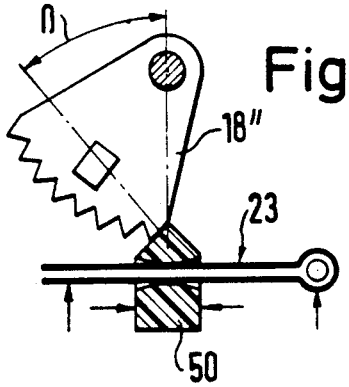
Fig. 18
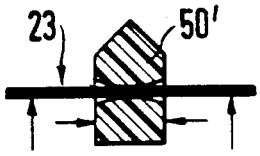

PROTECTIVE HELMET, WITH PIVOTING AND LOCKING VISOR MECHANISM, PARTICULARLY FOR MOTORCYCLISTS

The invention pertains to a safety helmet, especially for motorcyclists, with a visor plate covering the face opening, which is mounted pivotably on the side of the helmet shell and is lockable at least in its closed position by means of a locking device consisting of a locking cam and a locking element provided with at least one locking recess, as well as a spring element tensioning the locking cam and the locking element against each other in the direction of the pivot of the visor, with the locking element or locking cam being pivotably mounted with the visor plate.

Safety helmets with visor devices for pivoting and locking the visor plate in various positions, at least in the two extreme positions, are known in the art. Moreover the conventional adjustment devices are relatively complicated and constructed from many individual parts, which considerably increases the price of a helmet. For this reason, in many cases inexpensive spring elements made of synthetics are unfortunately used for locking the visor device in the case of safety helmets. However, these spring elements have the great disadvantage that, when they are continually under load—as is the case in a visor device—they are prone to so-called "creeping," i.e., the forces eventually approach zero.

Thus, such visor devices are a major safety risk since, for example, a sudden opening due to slackening of the spring tension force at high speed can put the driver into a very dangerous situation which must always be avoided.

Due to their substantially lower tensile stress for the existing, structurally predetermined mounting space, metal springs, to date, could not be optimally dimensioned to achieve the required, predetermined endurance without breaking. For this reason, it has not been possible, to date, to use, e.g., simple, metallic leaf springs which are inexpensive to manufacture.

In addition, there is a need for the visor plate to be relatively easy to replace by a layman since damage to the visor plate frequently occurs, e.g., even by simple scratching or dulling. Accordingly, the visor device with a locking device should also be designed such that, even after replacing without specific adjustment and setting manipulations, the pivoting movement and the locking function perfectly, since incorrect attachment or incorrect locking, as mentioned above, may lead to serious accidents if, for example, when the driver turns his head, the closed visor plate is ripped open by the wind pressure due to incorrect replacement or function of the locking device, in which case the driver is exposed to the full wind pressure with simultaneous reduction of the field of vision and possibly shearing forces acting on his head.

Consequently, there is a need for safety helmets with a visor device which are both inexpensive to manufacture and simple to handle and which, in addition, guarantee a high safety level when driving, i.e., even if the driver turns or moves his head, an unintentional opening of the visor is safely prevented.

Moreover, the visor device should be designed such that it is suitable for preformed visor plates as well as for flexible visor plates which, when installed, are flat plates; multilayer plates can also be used as flexible visor plates.

Thus, according to knowledge gained prior to the present invention, an opening of the visor plate upon the occurrence of wind pressure should be safely prevented independently of whether the edge of the visor plate rests on the edge of the face opening of the helmet or its edge engages in a depression around the face opening in the helmet such that the outer contour of the helmet always runs above the visor plate.

The task of the invention is to disclose a safety helmet with a visor device which is inexpensive to manufacture and simple to handle and which, in addition, guarantees a high level of safety, even when driving at high speeds as well as after long-term use of the helmet, such that unintended opening of the visor is safely prevented when turning one's head. Moreover, the locking forces necessary for holding the visor plate in the closed position should remain virtually constant during the lifetime of a helmet, by using simple springs in conjunction with a simple design consisting of few parts.

Furthermore, replacement of the visor plate, whether a simple flexible visor plate or a multilayer plate, should be as easy as possible without the need for any subsequent adjustment of the holding force for the locking device.

The above-mentioned task is solved by a safety helmet with the characteristics of Patent claim 1, in which case the requirements additionally formulated with the task can simultaneously be fulfilled. The objects of the subclaims are advantageous variants and improvements of a safety helmet with a visor device in accordance with the proposal according to Patent claim 1.

Even in a safety helmet according to the invention, as in a previously proposed safety helmet, at least one side of the visor plate is provided with a locking element that is untwistably connected to the visor plate, said locking element, together with the visor plate, being pivotable on a hub part in the interior of a bearing piece, with a locking device, e.g., in the form of a locking cam, additionally provided in the bearing piece, which works together with the locking element on the visor plate or its recess. The locking cam and locking element are pretensioned with spring action towards each other such that faultless interaction between the locking cam and the locking element is guaranteed. The locking element and the visor plate provided with a hub for the pivot movement are detachably attached on the side of the helmet shell, e.g., by means of a screw. Moreover, the helmet shell can possibly have a recess in this area to receive the bearing piece.

Thus, according to an advantageous variant, the bearing and locking element proper can be provided with a projection in the form of a circle segment, on the periphery of which locking notches are arranged which work together with a leaf spring attached in the bearing piece proper and having at least one locking cam.

According to an improvement of the object of the invention, stable end positions of the visor device are obtained by designing the locking notches with different depths, in which case the two locking notches for the end positions should especially be made deeper than the notches for securing the intermediate positions.

In order to guarantee a secure position of the visor plate at least in the closed position, according to an improvement of the object of the invention, the locking recess of the locking element which is assigned to the closed position is displaced such that, depending on the spring-loaded locking cam, a pretension force in the closing direction is exerted on the side walls of the locking recess and consequently on the locking element and the visor plate. This offers the advantage that—otherwise with an extremely low locking force—the visor plate is firmly pressed onto the possibly recessed edge of the face opening of the safety helmet.

According to another improvement of the object of the invention, the locking recess which is assigned to the open position of the visor plate is also displaced in the locking element such that, in this position as well, a pretensioning is achieved in the direction of the open position so that an absolutely stable and constant position of the visor plate is also guaranteed in the open position, and even when the helmet is used with opened visor, for example, when driving slowly or even when moving on foot, no wobbling or vibration of the visor plate need be taken into consideration.

By means of the particular type of arrangement of the locking recesses and their design with respect to the sides touched by the locking cams, a continuously effective closing force is obtained which can be applied by a leaf spring by a simple spring force directed in the direction of the pivot axis of the visor plate.

The magnitude of the force is dependent on the angle of incidence of the locking cam and the slope of the working surface at the locking element bearing of the locking recess.

In addition, according to an advantageous embodiment, a locking recess of a locking element is arranged and shaped such that, to produce the pretension force, a displacement of the engaging points of the locking cam over the entire length of the linear rise surface of a locking recess results in a pivot angle range of the visor plate of between approximately 5° and 15°, preferably 8°, which is adequate for a sufficiently high closing force of the visor plate against the face opening of the helmet, given the flexibility and elasticity of the parts used for the locking device as well as of the visor plate itself.

The result is that, considering all serial tolerances occurring on the visor components, a very high closing security is guaranteed while the locking spacing is still sufficiently small.

In order to guarantee the full force of the locking cam on the closing pressure of the visor plate, according to another improvement of the object of the invention, the angle between the force direction derived from the side of the locking cam and the force direction of the spring element itself in the direction of the pivot angle is selected between 25° and 45°, preferably 35°.

In this case, the spring element is subjected to a very high load and is thus an endangered component, also with respect to the simultaneous fulfillment of the stringent multi-cycle test which such visor devices must undergo.

In order to fulfill these requirements, according to another improvement of the object of the invention, it is proposed that the spring element be designed as a single-layer or multilayer leaf spring, in which case if a multilayer leaf spring is used, preferably only the spring leaf which is located opposite the locking element forms an arc-shaped or angle-shaped locking cam.

Details and improvements of a safety helmet with a lockable visor device according to the invention are explained below with reference to the individual figures in the drawing. In the drawing, FIG. 1 shows a safety helmet with a visor device in perspective view;

FIG. 11 shows a swung-out exploded view of another embodiment of the locking device;

FIGS. 12–18 show various designs of locking springs and/or arrangements;

Figure 1A:
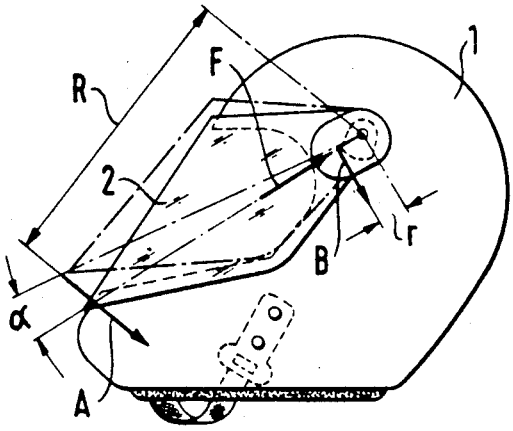
FIG. 1A shows a corresponding safety helmet in a lateral view with dimensioning of the arrangements which are essential for understanding the invention.
Figure 1:
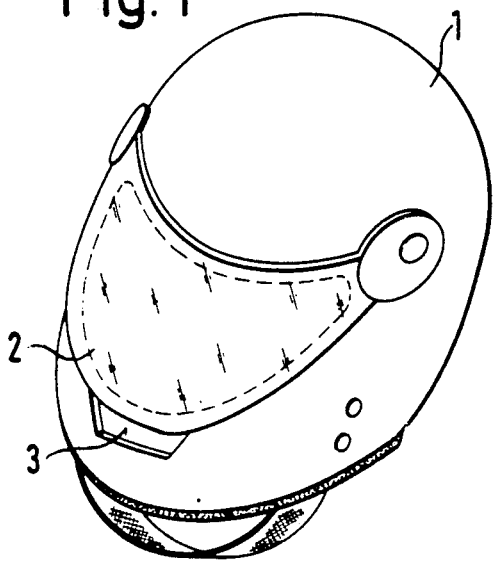

FIG. 1 schematically shows in perspective view a safety helmet with helmet shell 1 and visor plate 2. The visor plate 2 covers the face opening in the helmet shell. In order to be able to unblock the face opening, the visor plate is pivotably attached laterally on the helmet shell of the safety helmet, so that, when it is swung upwards, the face opening is unblocked and can be closed again by swinging the visor plate down. For reasons of aerodynamics, the edge of the visor plate lies flush on the correspondingly shaped helmet shell or an edge recess in the helmet shell.

To facilitate grasping the visor plate 2 and swinging it upwards, a recess 3 is provided on the front of the helmet shell 1 for gripping below the edge of the visor plate 2.

FIG. 1A shows a lateral view of the helmet, in which case the mutual spatial arrangement of the helmet shell 1, the visor plate 2, the bearing point of the visor plate and the pivot angle are dimensioned so as to make the effect of the individual parts easier to understand in conjunction with the explanation of these individual parts.

Figure 2:
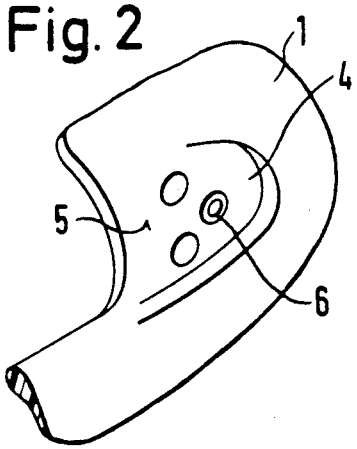
FIG. 2 shows the bearing and/or attachment recess on one side of the helmet shell.

From FIG. 2, it can be seen that screw-on surfaces 4 are provided on the helmet shell, which have recesses 5 for attaching a bearing piece to be attached there, as is explained below. The bearing piece itself is attached by means of a screw. For this purpose, an attachment nut 6 is arranged in the screw-on surface 4.

Figure 3:
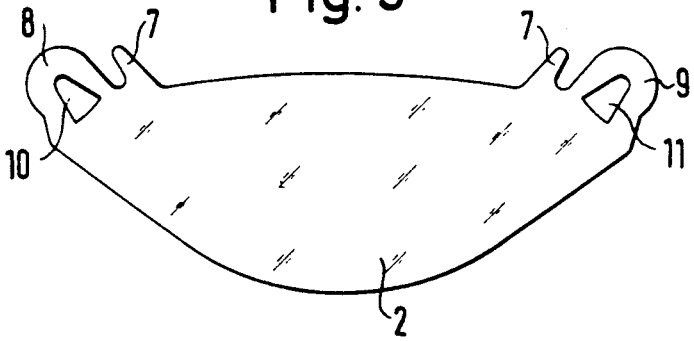
FIG. 3 shows the flat developed view of one embodiment of a visor plate.

FIG. 3 shows a top view of the development of a visor plate 2 in the form of a flat plate, as can be manufactured from transparent, flexible synthetic material. This plate is shaped, for example, by punching. It has two recesses 10 and 11 on its two ends 8 and 9, respectively, for receiving a bearing and locking element, the design, structure and function of which are explained below. Moreover, in the area of the ends, projections 7 have been left which, together with the ends 8 and 9, form a buffer slot, the function of which is also explained below.

Figure 4:
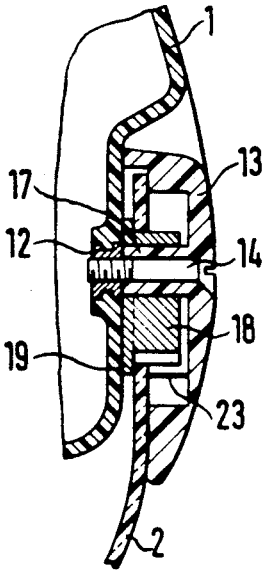
FIG. 4 shows a longitudinal section through the area of the bearing and attachment parts of a mounted visor device.

The mounting of the visor plate 2 on the outside of the helmet can essentially be seen in the sectional view in FIG. 4. The section shown there of a longitudinal section of a helmet shell 1 has in the attachment area an attachment nut 12 for receiving a screw 14, by means of which a bearing piece 13 is screwed on. Thus, the attachment takes place by means of projections 15 and 16 (FIG. 5) which engage in the recesses 5 (FIG. 2) on the helmet shell. In its attachment area, the bearing piece 13 has a hub part 17, through which the screw 14 is passed and on which a locking element 18 with free motion is pivotably mounted together with the visor plate 2. The locking element 18 has a shoulder 19 towards the helmet shell, of which the surface facing the helmet shell slides on the outside surface of the helmet shell in the attachment area.

The side of the locking element 18 facing away from the shoulder has a projection 20 (FIG. 7) which extends in the shape of a circle segment from the boring 21. In addition, recesses 10 and 11 in the visor plate 2 are fitted to the outside contours of the segment-shaped projection 20.

Locking recesses 22, which work together with a correspondingly shaped locking spring mounted in the bearing piece 13, are provided on the outside circumference of the segment arc of the projection 20. In the exemplary embodiment shown, the locking spring is designed as a two-piece leaf spring 23, 24, with the leaf sprig 23, which is assigned to the locking recesses, having a locking cam 31 which, as can be clearly seen from FIGS. 5 and 6, engages in a corresponding manner with the locking recesses 22.

Figure 6:
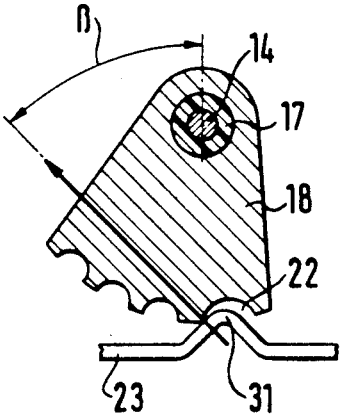
FIG. 6 shows a top view of a cut-out of the formation of the locking device operative for the closed visor.

Moreover, the rise of the locking cam, cf. FIG. 6, is selected such that the direction of the force exerted when the locking cam slides into a locking recess 22 forms an angle that should be between 25° and 45°, preferably 35°.

As can also be clearly seen from FIG. 6, the right recess 22 assigned to the closed position is arranged such that the locking cam 31 of the locking spring 23 rests on the side rather than reaching the full locking depth and exerts a pressure on the locking element and thus on the visor plate in the closing direction. Thus, the locking recess is displaced such that a shift of the engaging point to generate the pretension force through the locking cam over the entire length of a rising surface of the locking recess 22 forms a pivot angle range of the visor plate 7 between 5° and 15°, preferably 8°. By this means, the corresponding pretension with closed visor is achieved by means of a simple leaf spring which is fully sufficient to keep the visor plate securely closed. In fact—and reference is again made to FIG. 1A for this purpose—a holding force B at the locking distance r must be correspondingly high, specifically to generate a holding force A at the lower edge of the visor plate which is greater than the holding force B by the factor of R/r. In the area of the locking element, this requires a spring force which, as described above, is achieved by means of a simple cam spring in conjunction with the correspondingly arranged locking recess over the rise angle of the cam.

Figure 7:
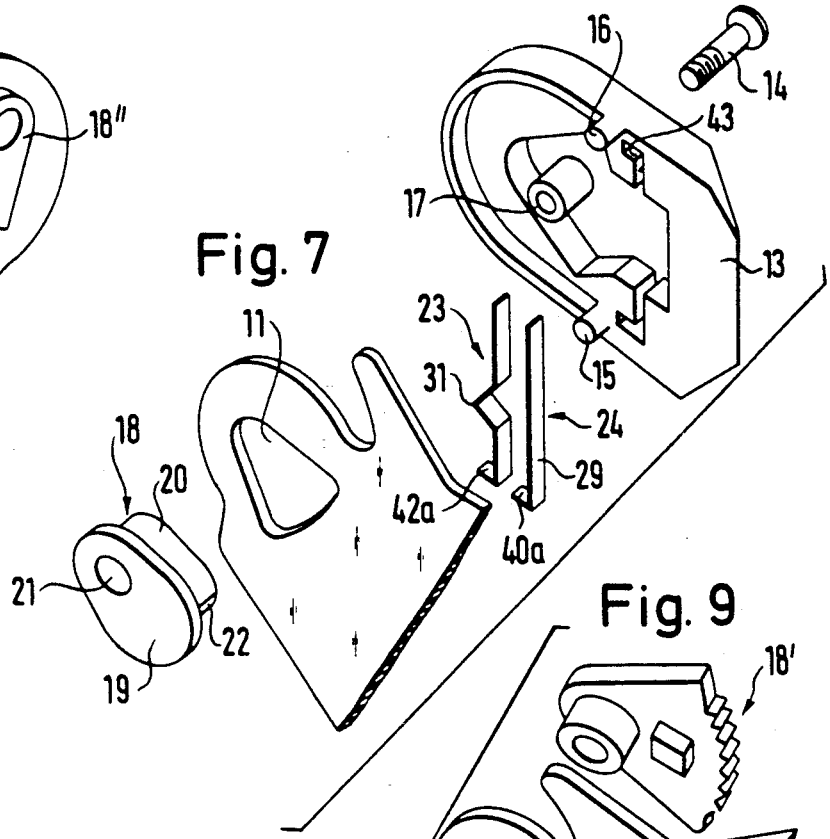
FIG. 7 shows an exploded view of the bearing and locking elements on one side of the helmet shell in a possible embodiment.

In order to generate the desired locking force, a two-layer spring is provided instead of a simple locking spring, as can be seen in FIG. 7, with the upper leaf spring 23 facing the locking recess having a locking cam 31 and being angled on one side 42 for the spatial attachment in the holding part 13. In practical construction, this spring provided with a locking cam is made slightly thinner than the flat support spring 29 below it, which, due to its smooth shape, can tolerate a correspondingly higher load. In the embodiment shown according to FIG. 7, this spring (holding projection 40) is also angled even though this leaf spring per se need not be spatially attached with precision.

Figure 5:
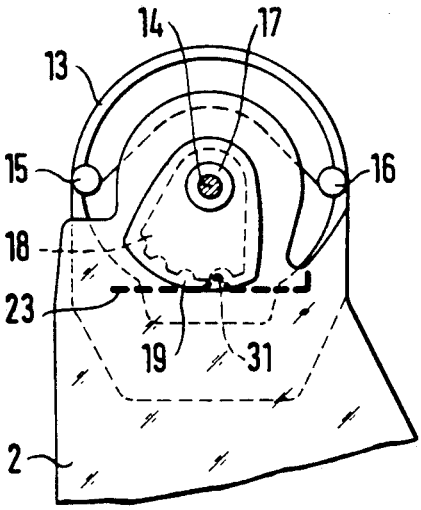
FIG. 5 shows a top view of the locking device.
Figure 8:
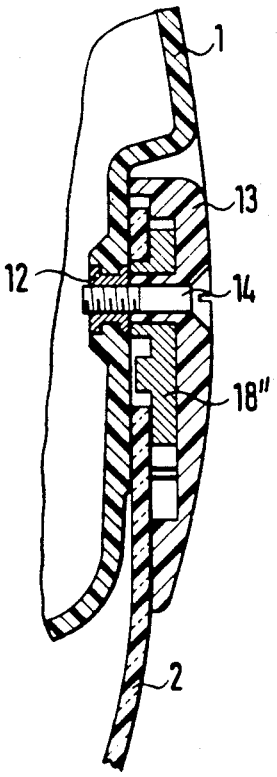
FIG. 8 shows a longitudinal section, analogous to FIG. 4, through the bearing and attachment parts of another embodiment possibility with enlarged locking arc.
Figure 8A:
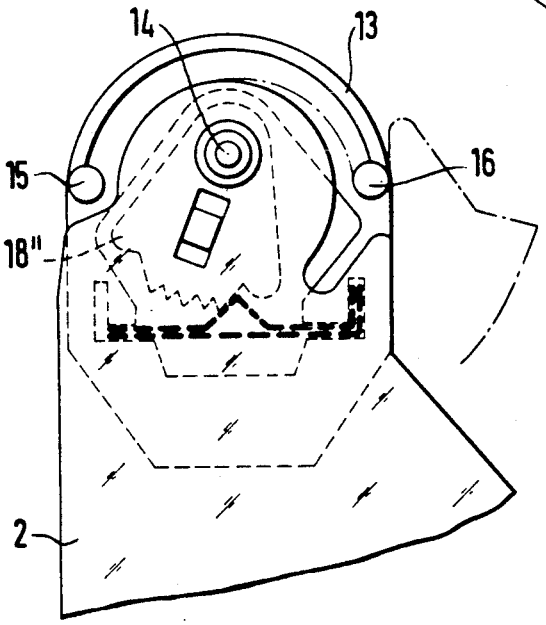
FIG. 8A shows a top view of the inside of the locking device according to FIG. 8.

FIGS. 8 and 8A show representations of this embodiment analogous to FIGS. 4 and 5. In addition, it can be seen in FIG. 8A that the slot formed by the ends of the visor plate and the projection rests on the projection 16 in the open position.

Figure 10:
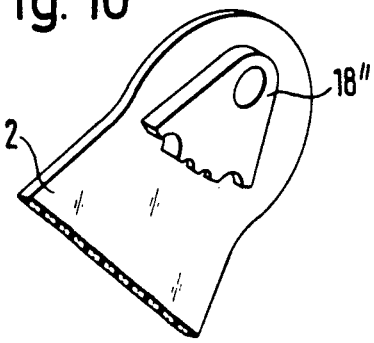
FIG. 10 shows the end of a visor plate manufactured by an injection method with single-piece bearing and locking component.
Figure 9:
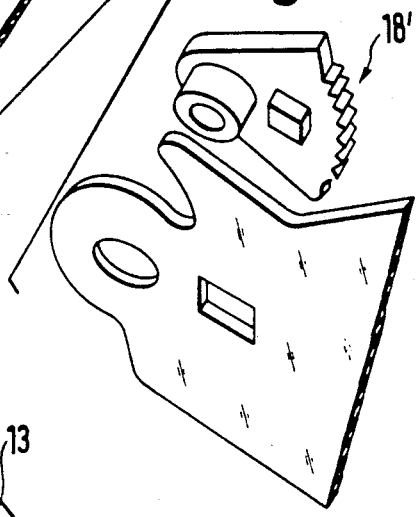
FIG. 9 shows an exploded view of the locking element and the visor plate end of a locking device according to FIG. 8 or 8A.

FIG. 9 shows another design of a bearing and locking element 18', and FIG. 10 shows that, within the scope of the invention, the bearing end of the visor plate 2 and the locking element 18'' can also be designed as a single piece.

In another embodiment, FIG. 11 shows a modification of the locking element arrangement in which a separate bearing piece 13 is eliminated.

The pivotable mounting of the visor plate is formed by a bearing neck 47 which can slipped in and which is pressed in through flush borings in the visor plate 48 and in the helmet shell 48'.

The locking element is attached on the inside of a visor plate 45 in the form of an arc-shaped ledge 46 and is guided in a corresponding recess 42 of the helmet shell in the area of the bearing surface 4.

In addition, the arc-shaped locking ledge 46 works together with a two-layer locking spring 40 and 41 which is also held in grooves 43 of the recess 42.

FIGS. 12–18 show various spring designs and spring arrangements.

In an embodiment according to FIG. 12, the leaf spring 41 which is provided with locking cams is spatially attached by means of an angled end, while the continuous leaf spring 40' below it is only correspondingly supported. In an embodiment according to FIG. 13, as already described above, both the lower leaf spring 40 and the upper leaf spring 41 are laterally attached by means of angled brackets.

It can be seen from FIG. 14 that, within the scope of the invention, it is naturally also possible to provide multilayer leaf springs, specifically an uppermost leaf spring 40 provided with a cam, which is spatially attached, and additional leaf springs 40' and 40''.

FIG. 15 shows that, within the scope of the invention, a multilayer leaf spring can also be manufactured as a single piece, insofar that the spring band is accordingly bent around a holding pin 27, by means of which the single-piece locking spring 23, which acts as a double-layered leaf spring, is spatially attached at the same time as the holding pin 27 is spatially attached.

As can be clearly seen from FIGS. 16–18, to increase the holding force, the locking cam can also be designed as an additional part 50, preferably made of a synthetic material, which is correspondingly slid onto a single-layered or double-layered leaf spring and attached in the position corresponding to the action of the locking device. By this means, it is then possible to use one or two very stable continuous leaf springs to generate the locking pressure, which springs are not in any way weakened, even partially, by the formation of cams. This then also makes it possible to use a simple thick leaf spring as can be seen from FIG. 18.

In this embodiment, the springs do not require any special lateral attachment. Only the additional cam must be guided laterally with slight play equalling the depth of the locking recesses.

Figure 19:
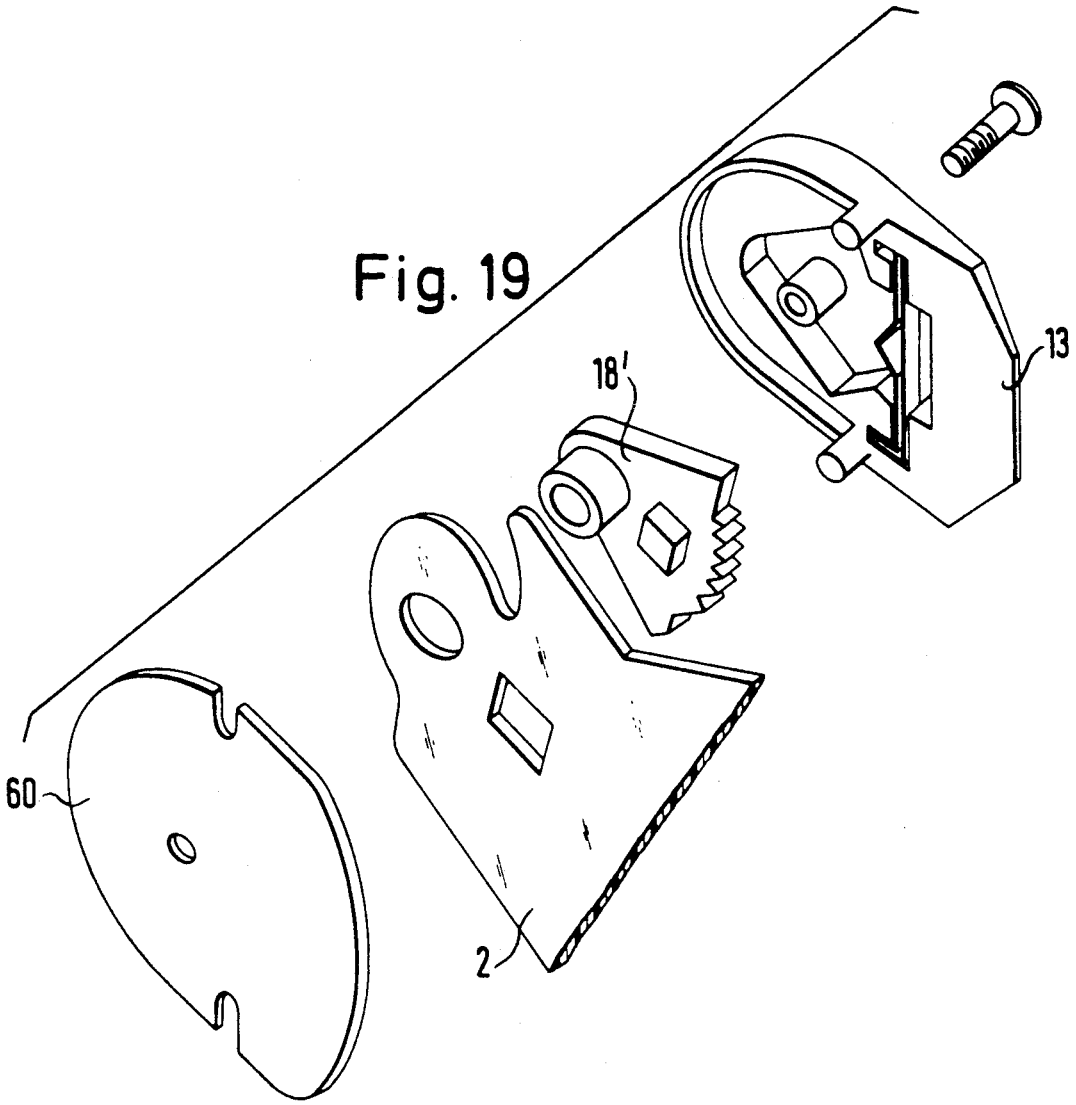
FIG. 19 shows an exploded view of another embodiment of the visor locking device.
Figure 20:
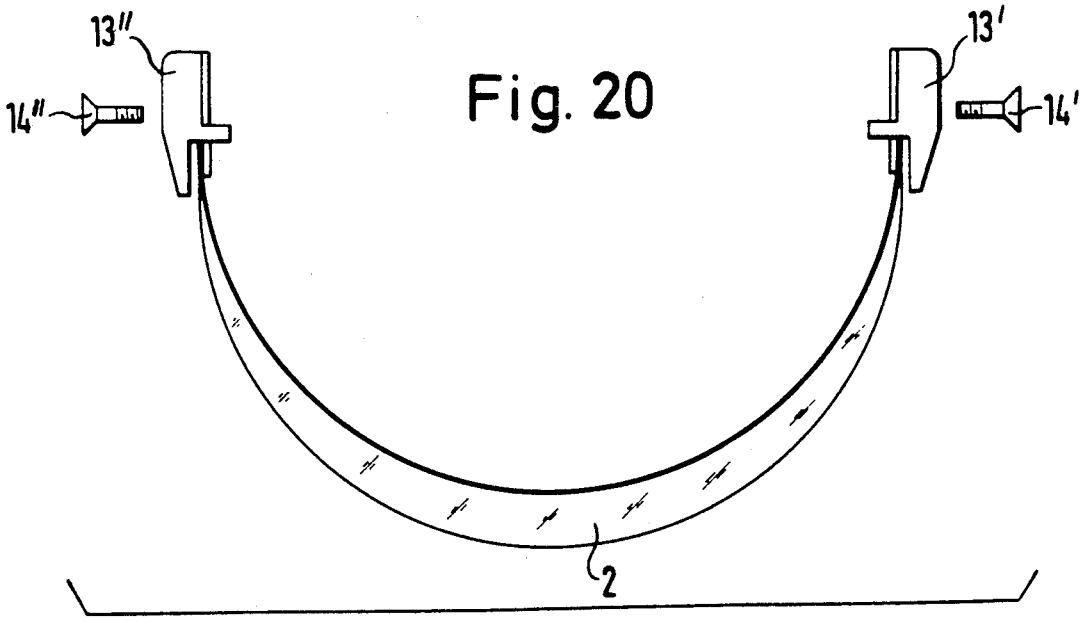
FIG. 20 shows a top view of a structural unit of the visor plate with bearing and locking element.

FIGS. 19 and 20 show an advantageous improvement of the entire visor, particularly in consideration of the delivery of spare parts. As already initially explained, it is important that a visor plate can be replaced rapidly and without problems. To illustrate this, corresponding to FIGS. 8, 8A and 9, FIG. 19 shows how to attach an additional safety plate 60 to the bearing piece during assembly by means of clips, glue, welding or the like which cannot be lost and which hold the visor plate and the locking parts secure during transport. The entire visor device can be attached to the helmet by means of two attachment screws 14' and 14''.

In all the embodiments described, it is possible to use springs with different dimensions on both sides of the helmet.

By this means, the locking device is cancelled only on one side when lifting, while that on the other side remains, so that the locking distribution is, for example halved to provide only minimal visor lifting. This may be advantageous when the visor is used when driving at low speeds.

I claim:

1. A protective helmet for motorcyclists, comprising:

a helmet shell defining a face opening;

a visor covering the face opening and mounted on sides of the helmet shell;

means engaging between the helmet shell and the visor for pivoting the visor between a closed position and an open position over the face opening; and, locking means on at least one of the sides of the helmet shell for maintaining the visor in at least the closed position, said locking means comprising a locking element defining at least one recess and being pivotable with the visor around a pivot point, and a spring element comprising an upper spring leaf and at least one lower spring leaf, the upper spring leaf defining a locking cam which is engageable with the at least one recess when the visor is in the closed position, the spring element releasably biasing the locking cam against a side wall of the at least one recess, whereby the visor is releasably maintained in the closed position and wherein the visor is pivotable between about 5° and 15° from the closed position when the locking cam is in contact with the side wall of the at least one recess.

2. The protective helmet according to claim 1, wherein the locking cam is displaceable.

3. The protective helmet according to claim 1, wherein the visor is pivotable about 8° from the closed position when the locking cam is in contact with the side wall of the at least one recess.

4. The protective helmet according to claim 1, wherein the locking cam exerts a force on the side wall of the at least one recess at an angle between about 25° and 45° from a direction of force of the spring element toward the pivot point.

5. The protective helmet according to claim 1, wherein the locking cam exerts a force on the side wall of the at least one recess at an angle of about 35° from a direction of force of the spring element toward the pivot point.

6. The protective helmet according to claim 4, wherein at least one end of the spring element defines a holding projection.

7. The protective helmet according to claim 4, wherein the spring element is metal.

8. The protective helmet according to claim 4, wherein the spring element consists essentially of a single piece of material which is bent to form the upper and lower spring leaves.

9. The protective helmet according to claim 4, wherein the upper and lower spring leaves are different in at least one of thickness and width.

10. The protective helmet according to claim 1, wherein the locking element is an arc-shaped locking ledge attached on an inside of the visor.

11. The protective helmet according to claim 9, wherein at least one of the sides of the helmet defines a recess dimensioned to permit movement of the arc-shaped locking ledge within the recess as the visor is pivoted, and further defines a groove dimensioned for receiving the upper and lower spring leaves.

12. The protective helmet according to claim 1, further comprising a retaining plate attached to the locking means on an internal side of the visor to prevent loss of the locking means during transport.

13. The protective helmet according to claim 12, wherein the retaining plate is attached to the locking means by at least one of clips, glue and welding.

14. The protective helmet according to claim 1, wherein the locking means is attached to the visor to form one structural unit.

15. The protective helmet according to claim 1, wherein the locking element has a circular segment shape, and a periphery of the locking element defines the at least one recess.

16. The protective helmet according to claim 1, wherein the locking element defines a plurality of recesses, and wherein the recesses corresponding to the closed and open positions of the visor have a deeper dimension than any other of the recesses.

17. The protective helmet according to claim 1, wherein the locking element defines a lug which is insertable into at least one mating aperture in the visor.

18. The protective helmet according to claim 1, wherein the locking means on opposite sides of the helmet are mirror-symmetrical.

* * * * *